US011761669B2

(12) United States Patent
Valdez

(10) Patent No.: US 11,761,669 B2
(45) Date of Patent: Sep. 19, 2023

(54) DUCT REPLACEMENT DEVICE AND METHOD OF USE

(71) Applicant: Raymond Armstrong Valdez, Fountain Valley, CA (US)

(72) Inventor: Raymond Armstrong Valdez, Fountain Valley, CA (US)

( * ) Notice: Subject to any disclaimer, the term of this patent is extended or adjusted under 35 U.S.C. 154(b) by 154 days.

(21) Appl. No.: 17/674,040

(22) Filed: Feb. 17, 2022

(65) Prior Publication Data

US 2023/0258362 A1 Aug. 17, 2023

(51) Int. Cl.
*F24F 13/02* (2006.01)

(52) U.S. Cl.
CPC ..... *F24F 13/0209* (2013.01); *F24F 13/0245* (2013.01)

(58) Field of Classification Search
CPC ..... F24F 13/0209; F24F 13/0245
See application file for complete search history.

(56) References Cited

U.S. PATENT DOCUMENTS

| | | | | |
|---|---|---|---|---|
| 5,901,985 | A * | 5/1999 | Raatz | F16L 37/1235 74/543 |
| 9,180,584 | B1 * | 11/2015 | Cook | B25B 33/00 |
| 9,303,887 | B1 * | 4/2016 | Chwala | F24F 13/32 |
| 11,149,980 | B2 * | 10/2021 | Emmons | F24F 13/10 |
| 2003/0177724 | A1 * | 9/2003 | Botting | F24F 13/06 52/302.1 |
| 2016/0039058 | A1 * | 2/2016 | Cole | F24F 13/28 29/428 |

* cited by examiner

*Primary Examiner* — James M Hewitt, II
(74) *Attorney, Agent, or Firm* — Eric Hanscom

(57) ABSTRACT

A duct replacement device and method of use provides a duct sleeve flex connector, in three different versions, each with a flat, rigid metal bar with thin, metal bracing strips and a female-treaded pole hinge. After cutting loose the old duct from under the register box, an HVAC technician enters the attic and threads the device on a telescoping pole, depositing the device near the open register box. The technician then climbs a ladder under the register box, grabs and adjusts the device with the flat, rigid metal bar into position, then attaches it with the thin, metal bracing strips.

4 Claims, 9 Drawing Sheets

DUCT REPLACEMENT DEVICE AND METHOD OF USE

CROSS REFERENCE TO RELATED APPLICATIONS

This application claims priority to U.S. Application 63/148,122, filed Feb. 20, 2020.

STATEMENT REGARDING FEDERALLY SPONSORED RESEARCH OR DEVELOPMENT

This invention was not federally sponsored.

BACKGROUND OF THE INVENTION

Field of the Invention

This invention relates to a duct interface device that can be used to easily and effectively connect a new air conditioning or heating duct to an existing register box.

Background of the Invention

It is well known in the industry that when contractors put register boxes into new houses, they often do not think of how difficult it will be to access and replace the ducts to these boxes, as the initial installation is usually done before ceilings are installed. It is much easier to get on a ladder and place a register box in between ceiling studs than 10 years later when the heating ducts need to be replaced, to climb into the attic and try to wiggle your body into position to detach the old duct and attach a new one.

Thus, there has existed a long-felt need for a device that allows an HVAC worker to easily, safely, and effectively access a register box, remove the old duct and attach a new duct.

The current invention provides just such a solution by having a duct replacement device and method of use provides a duct sleeve flex connector, in three different versions, each with a flat, rigid metal bar with thin, metal bracing strips and a female-treaded pole hinge. After cutting loose the old duct from under the register box, an HVAC technician enters the attic and threads the device on a telescoping pole, depositing the device near the open register box. The technician then climbs a ladder under the register box, grabs and adjusts the device with the flat, rigid metal bar into position, then attaches it with the thin, metal bracing strips.

There has thus been outlined, rather broadly, the more important features of the invention in order that the detailed description thereof may be better understood, and in order that the present contribution to the art may be better appreciated. There are additional features of the invention that will be described hereinafter, and which will form the subject matter of the claims appended hereto. The features listed herein, and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
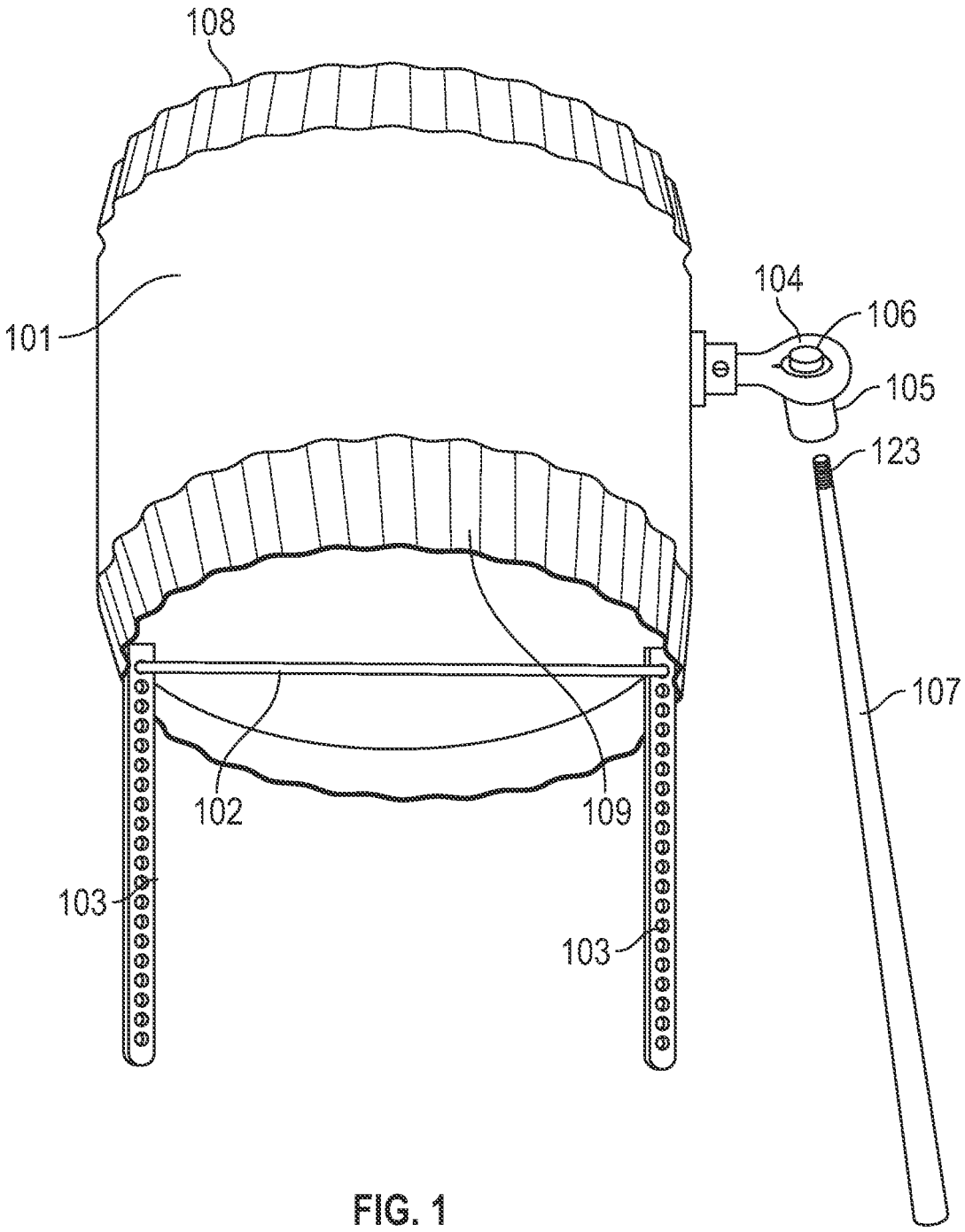
FIG. 1 is a perspective view of a cylindrical version of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of a cylindrical version of the invention. Note how the invention 101 has a duct sleeve 108, that fits into an inner circumference of a new duct, and a crimped male end connection 109, that fits into a boot of a register box. The female-threaded pole hinge 104 mates with a male-threaded telescoping pole 107 such that a work can maneuver the invention over a register box and deposit it there, rather than having to crawl into tiny crevices under the roof to get to the register box. A flat metal bar 102 extends from one side of the invention to the other and serves as a grab bar for a worker to grab the invention, pull it down into the boot of the register, and maneuver it into position. Two thin metal securing straps 103 are then bent to the appropriate shape and screwed through the register box into the surround wooden studs.

Figure 2:
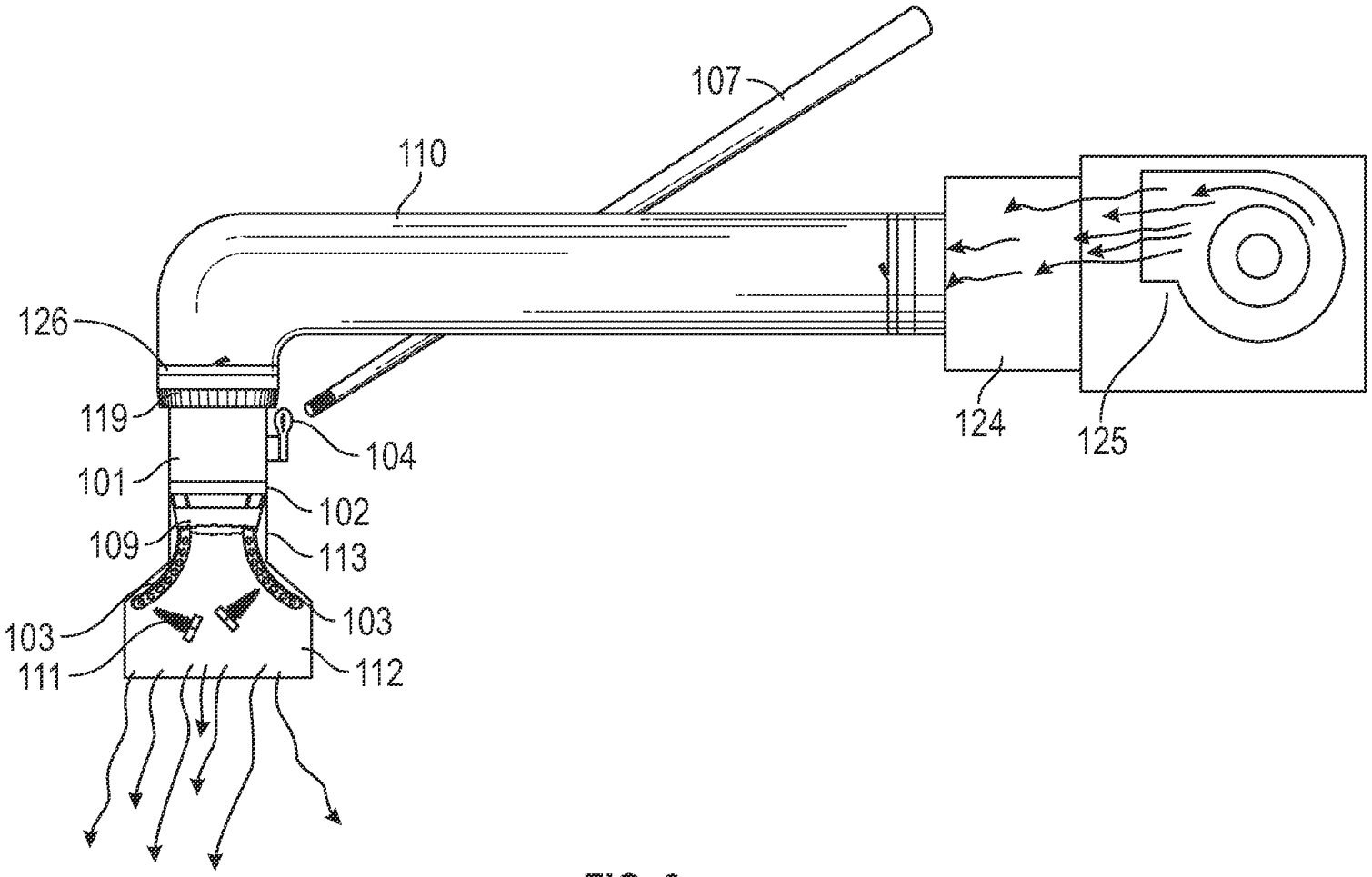
FIG. 2 is a side view illustrating the general layout of a duct and how the invention works to make replacing a duct safer, easier, and more efficient.

FIG. 2 is a side view illustrating the general layout of a duct and how the invention works to make replacing a duct safer, easier, and more efficient. Note how with the telescoping pole 107, the invention can be located right over the register box, without requiring the HVAC worker to crawl to the register box.

Figure 3:
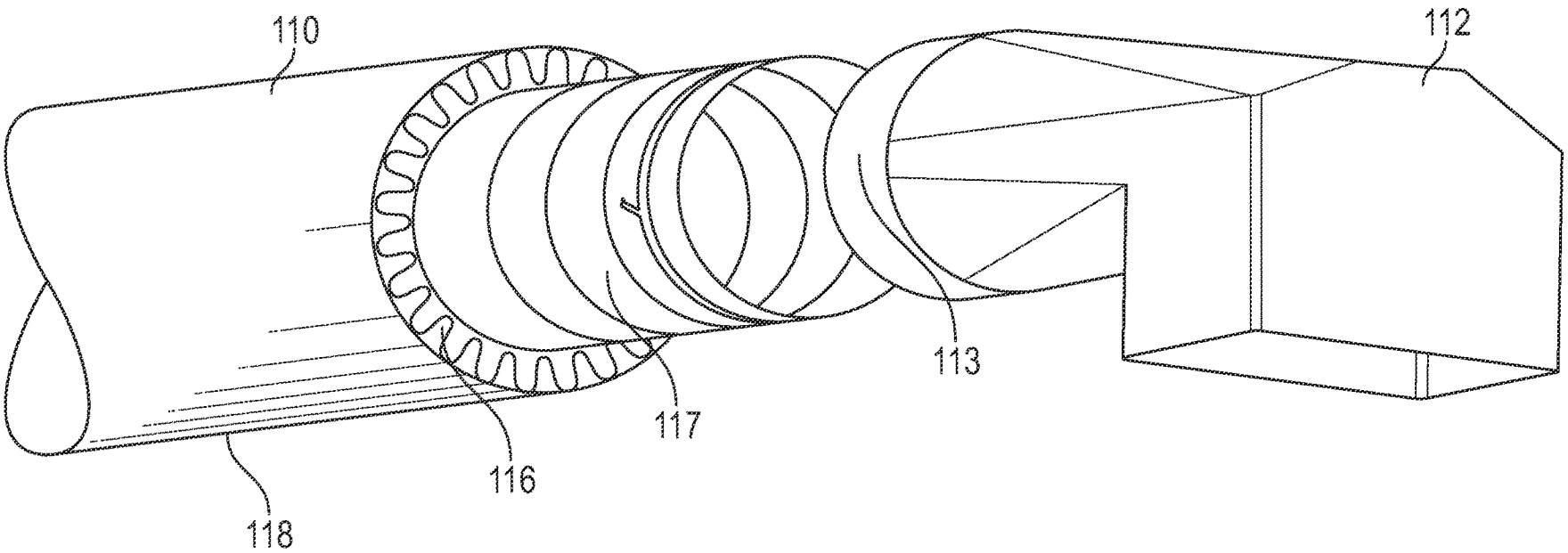
FIG. 3 is a perspective view of a box-like version of the invention.

FIG. 3 is a perspective view of a box-like version of the invention. Note how the invention has one end that fits inside the new duct, and can be attached to it, such that the telescoping pole can "lead" the invention, with the new duct in tow, to the register box.

Figure 4:
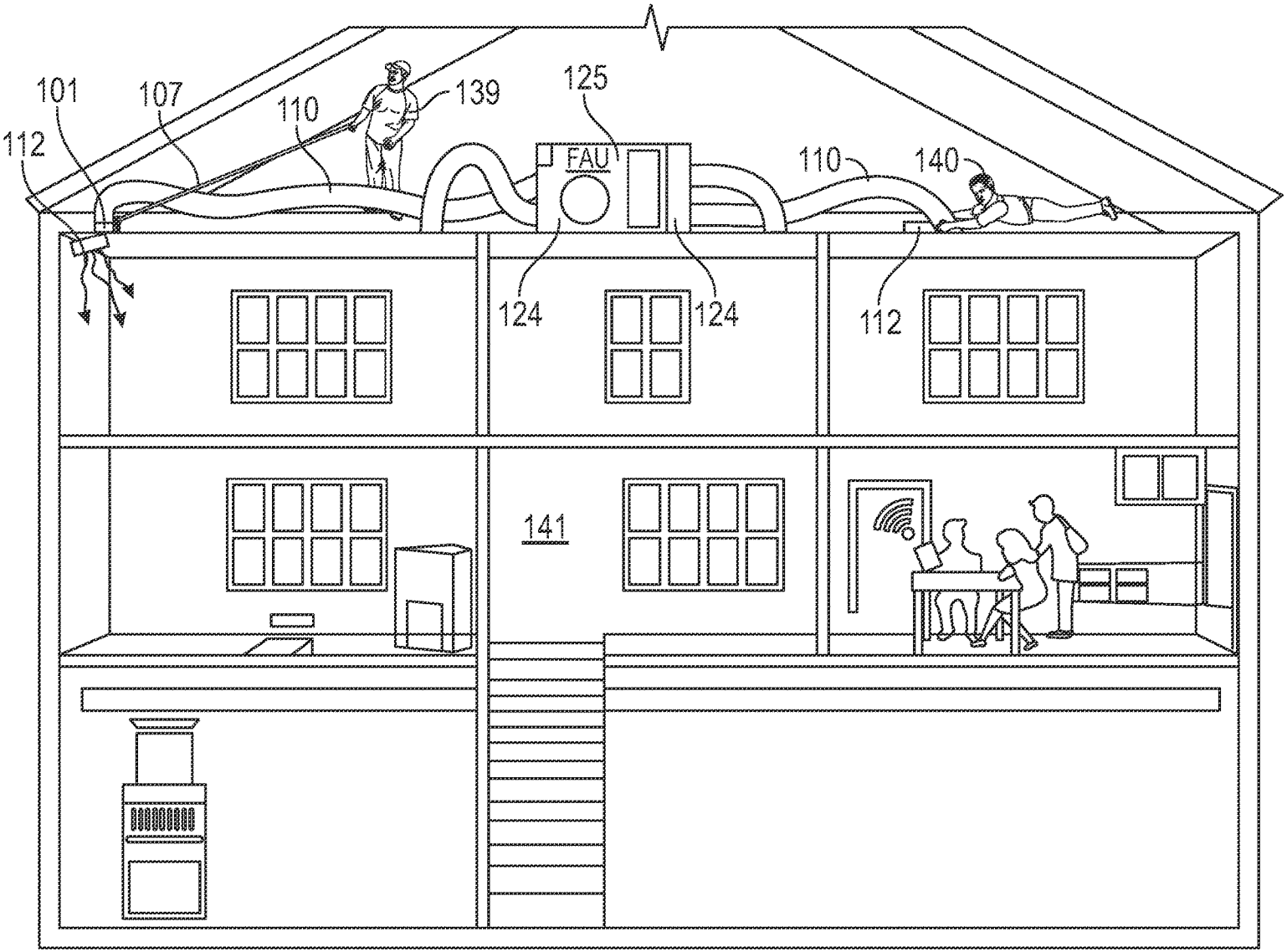
FIG. 4 is a cut-away side view of a house showing the difference in "ease of replacement" between a traditional HVAC worker and one using the invention.

FIG. 4 is a cut-away side view of a house showing the difference in "ease of replacement" between a traditional HVAC worker and one using the invention. Note how when initial contractors locate register boxes, they don't think about how difficult access may be once a ceiling is put in and a roof is installed.

Figure 5:
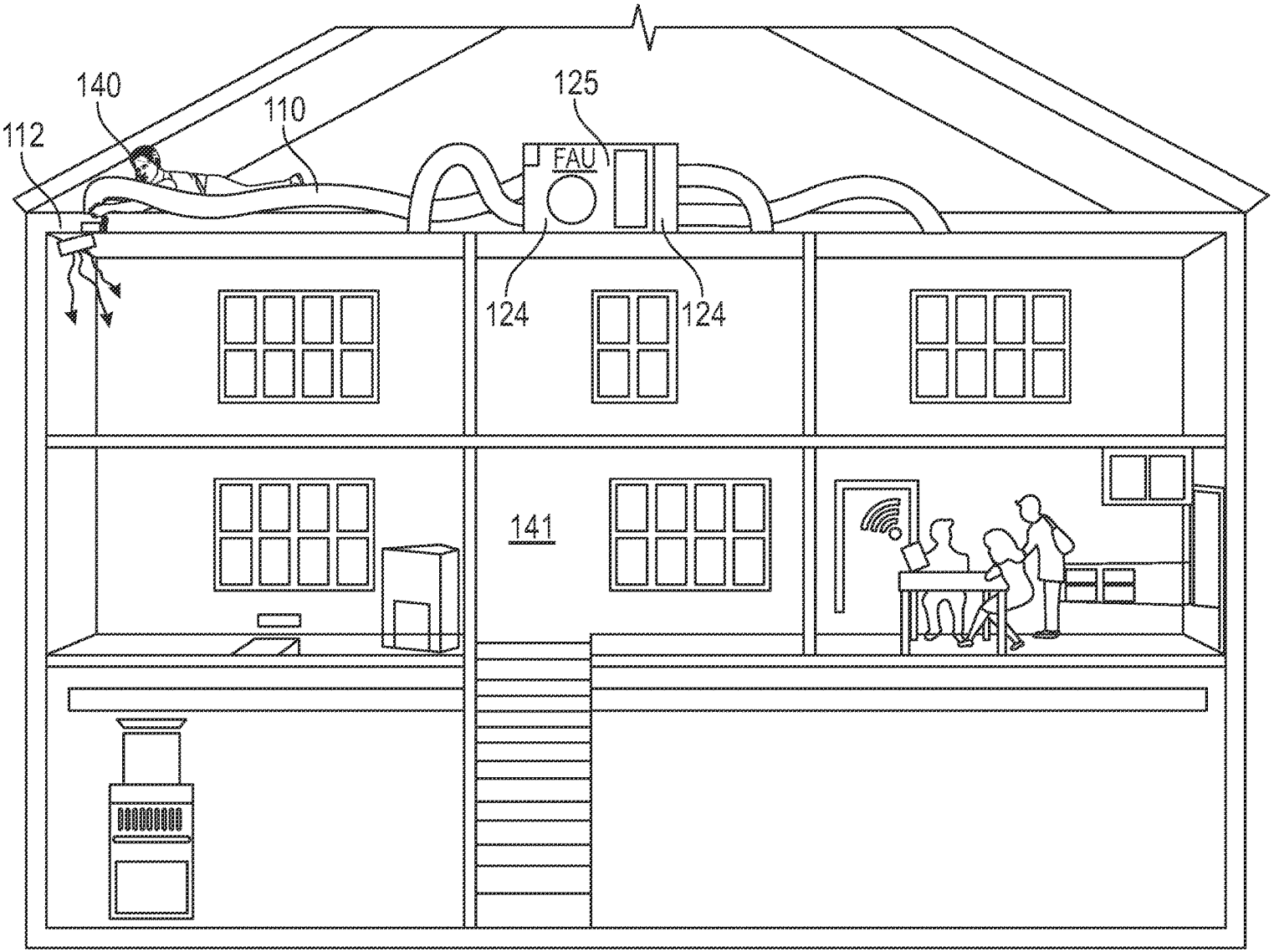
FIG. 5 is a cut-away side view of a house showing the problems encountered by a traditional HVAC worker trying to access a register box located and a tight corner under the roof.

FIG. 5 is a cut-away side view of a house showing the problems encountered by a traditional HVAC worker trying to access a register box located in a tight corner under the roof.

Figure 6:
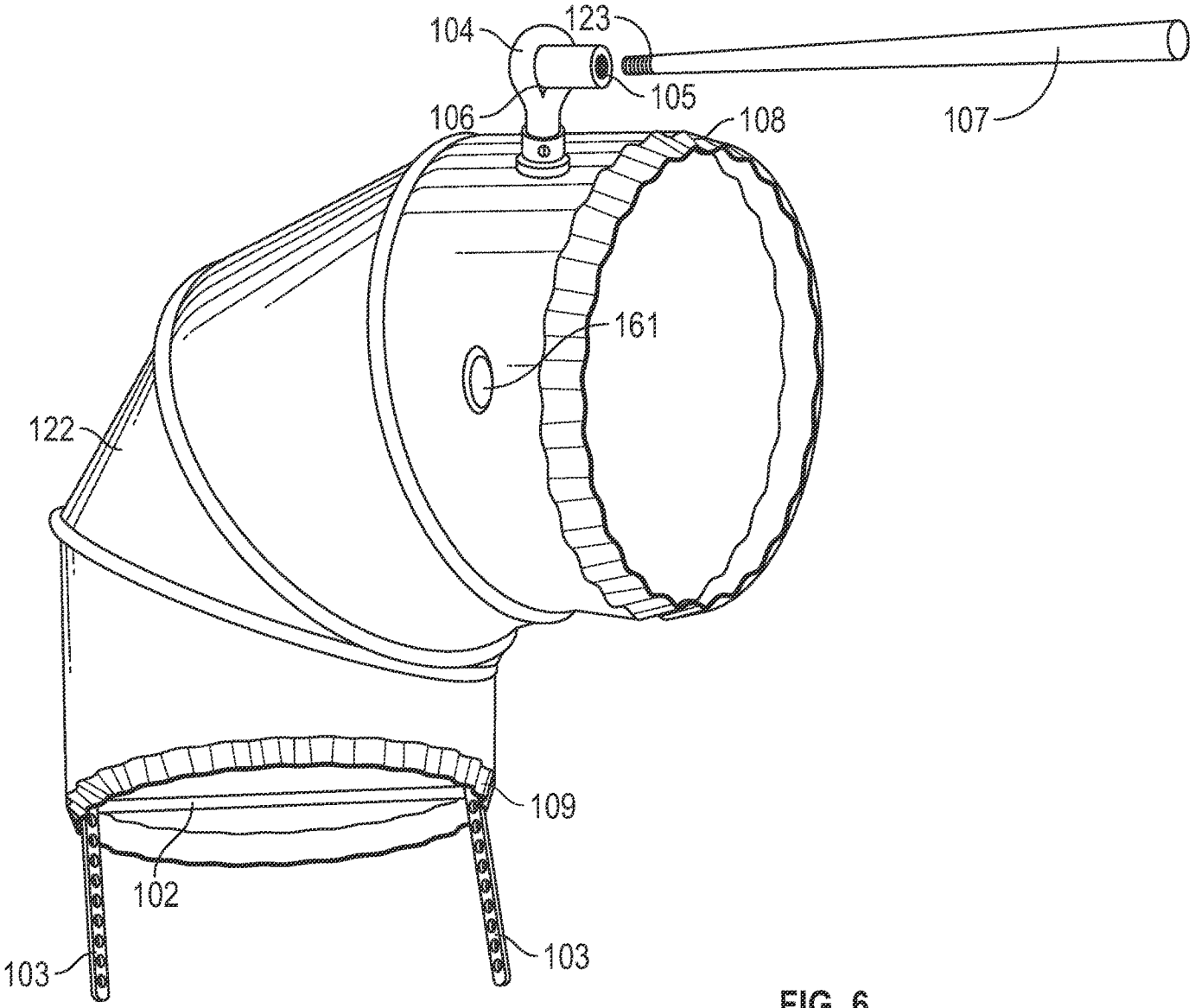
FIG. 6 is a perspective view of the 90-degree bend version of the invention.

FIG. 6 is a perspective view of the 90-degree bend version of the invention. In this version, the parts are very similar to the version shown in FIG. 1, but there is a 90-degree bend in the invention such that the new duct does not have to bend (and become in danger of crimping) as it reaches the register box.

Figure 7:
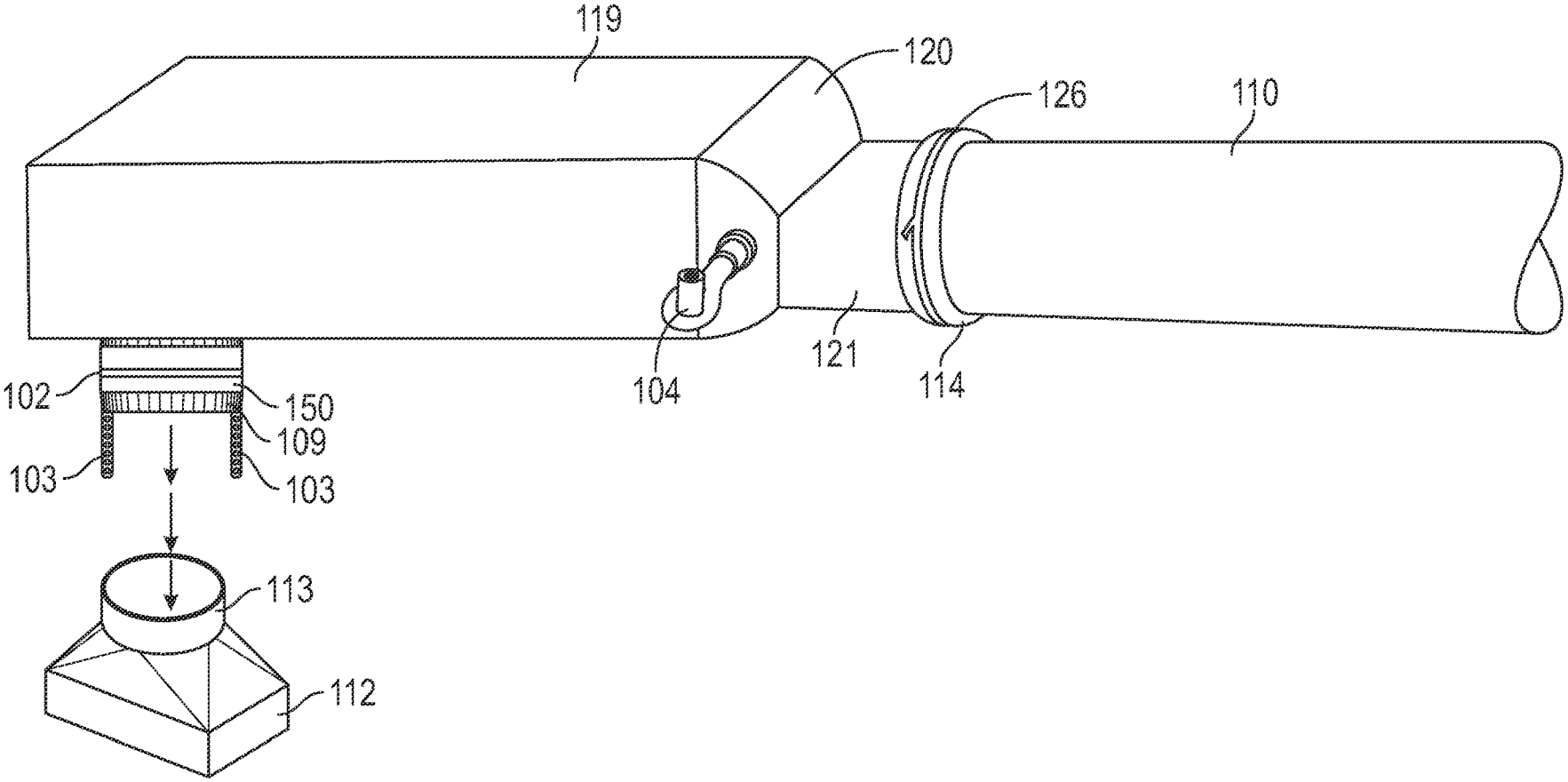
FIG. 7 is a perspective view of the box version of the invention.

FIG. 7 is a perspective view of the box version of the invention. This version is designed for very narrow areas, with the box duct assembly 119 providing an extension of the metal invention features in FIGS. 1 and 6, such that there is no need to risk crimping the new duct as the HVAC worker tries to connect it to the register boot.

Figure 8:
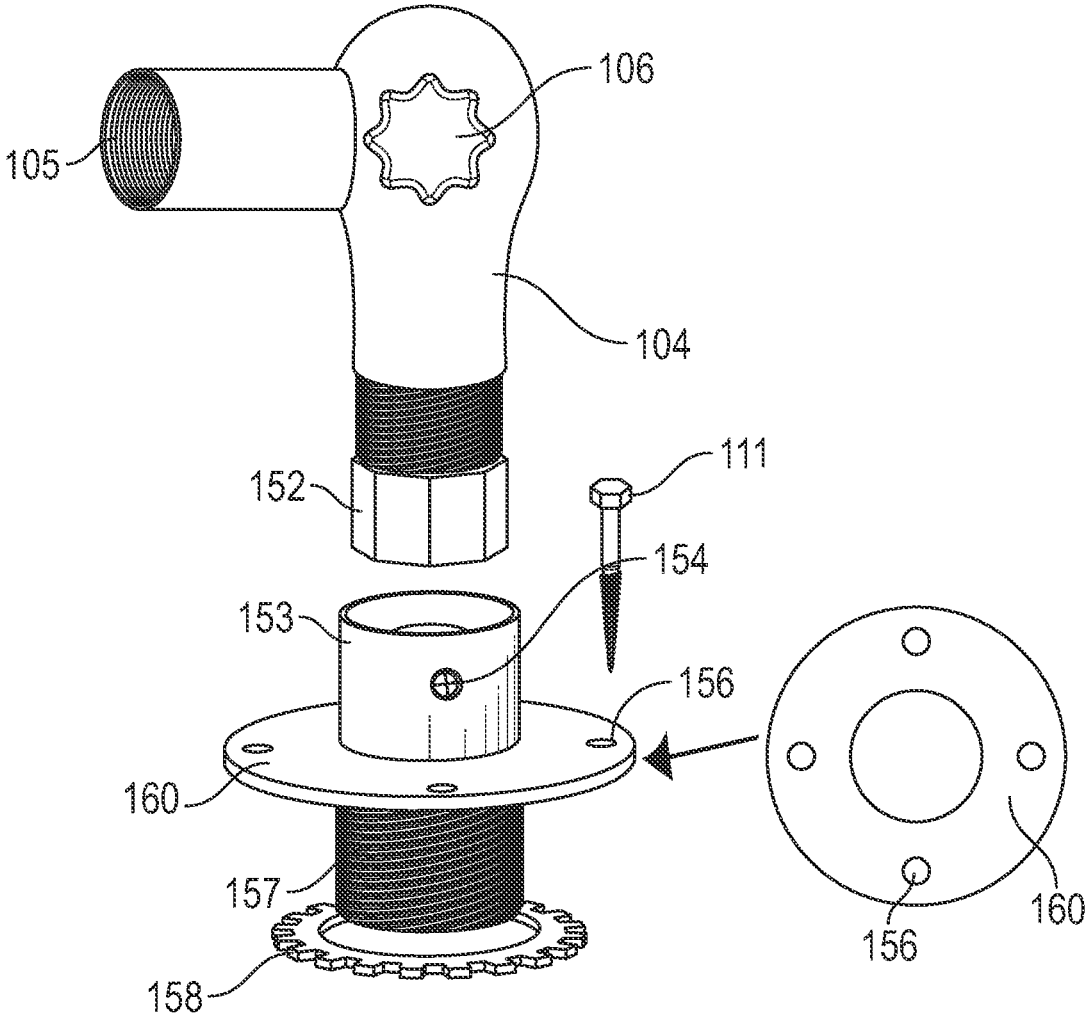
FIG. 8 is a side view showing a detail of the female-threaded pole hinge.

FIG. 8 is a side view showing a detail of the female-threaded pole hinge.

Figure 9:
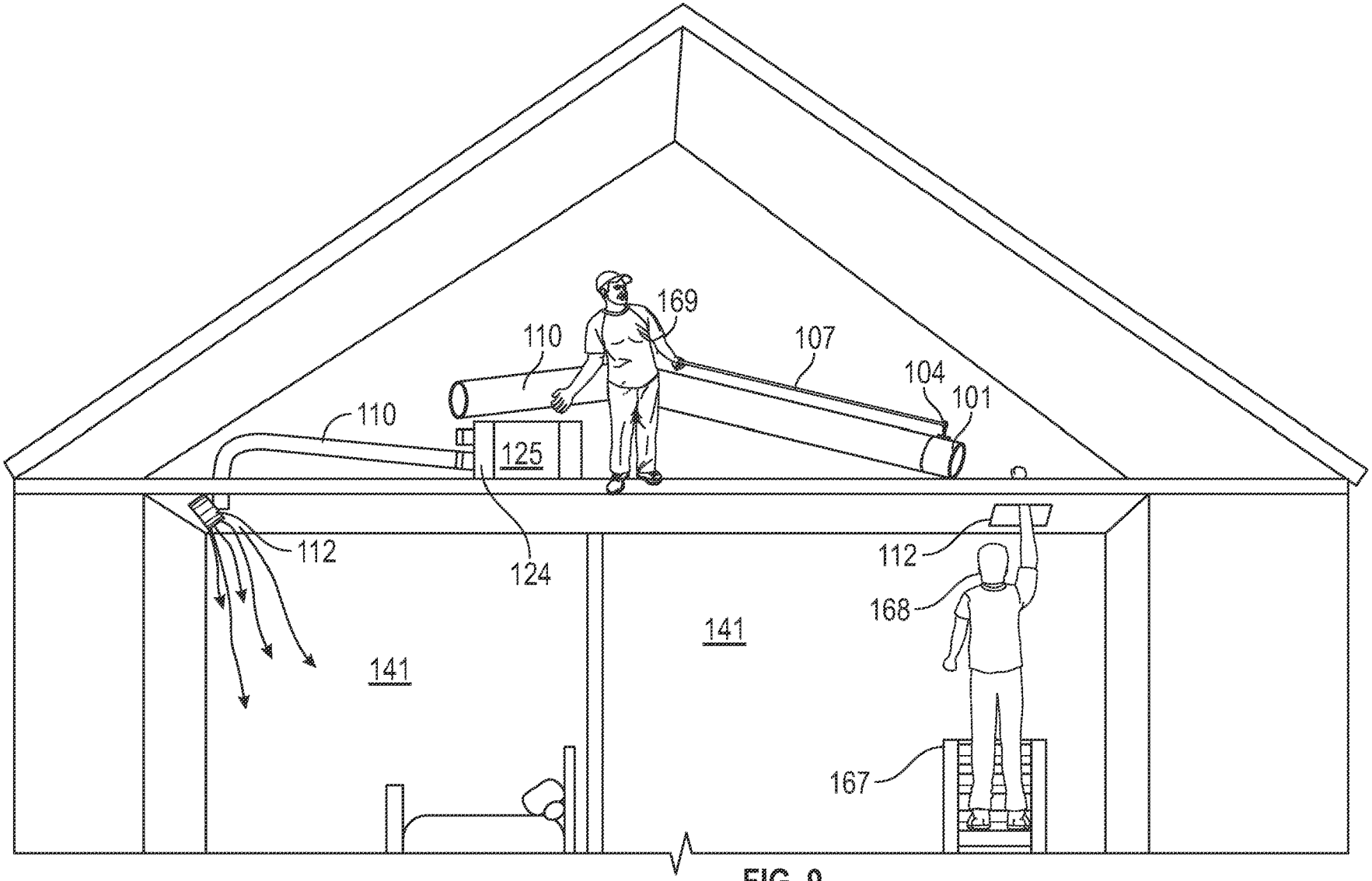
FIG. 9 is a cut-away side view of two HVAC workers coordinating the depositing of the device at the end of a new section of duct.

FIG. 9 is a cut-away side view of two HVAC workers coordinating the depositing of the device at the end of a new section of duct.

The following is an explanation of how the invention works:

In the HVAC field, the installation of a complete central NC & heating system consists of a number of steps. Some of the main components are 1) The outdoor condenser unit which is used to compress low pressure gas into liquid in order to remove heat from a conditioned space. Another main component is the air handler or FAU (125) (forced air unit) which is connected to an evaporator coil. The air handler uses a blower motor to move warm air across a cold evaporator coil in order to cool the warm air and distribute chilled air through a duct system. This duct system (FIG. 2) has a main distribution branch called an air supply plenum (124) which is typically square or rectangular in shape and made out of sheet metal. The rigid metal air supply plenum (124) has smaller round air supply branches connected and tapped into it called flex duct (110). The purpose of a flex duct (110) is to distribute a controlled amount of air (CFM) to a space (FIG. 2) of the appropriate square footage. The more air required, the bigger the diameter of flex duct (110) will be required. For example, a bathroom typically requires a 5" diameter flex duct while a bedroom would need an 8" flex duct (110) in order to cool the room properly. Flex ducts (110) are typically made of a thin mil plastic over a round metal wire coil to shape a tube (117). The tube is insulated with glass wool (116) and covered with a thin outer layer (FIG. 3,118) made of polyethylene or metalized PET that has a vapor barrier (FIG. 3,118). The flex duct (110) is connected from the supply plenum (FIG. 2,124) to an existing register.

A supply register box (112) is a square or rectangle shape box that is made of sheet metal. This box has a round diameter boot (113) that is tapped into the center of the box. The boot (113) on the register box (112) is for the purpose of connecting the end of a flex duct (110) to the register box (112). The register box (112) is the open-end ride for the conditioned air that is introduced into the air-conditioned space (FIG. 2).

During the new construction phase of building, register boxes (112) are hung between the ceiling rafters in each room and living space during the framing stage before the drywall is installed in the building. During this time the flexible duct system will be run above the ceiling in the attic space. Multiple flex ducts (110) of various diameter sizes and lengths of flex duct (110) ranging just a few feet to many feet are run all across the attic space of the building. It is at this time that a proper flex duct (110) to air register box (112) connection is made. A proper flex duct (110) to register box (112,113) connection is very important to prevent air leakage when the FAU (125) is distributing air to the conditioned space. Air leakage in ducts cause inefficient NC operation and very costly troubleshooting procedures to correct if an HVAC technician has to troubleshoot to locate the air leak after the building has been completed and the A/C system has been installed. A leaking duct repair would very difficult because the attic insulation, water pipes, gas pipes and wires etc. . . . running across the attic, makes the attic space too narrow to reach the leaky duct connection without removing sections of ceiling drywall in order to access the leaking duct connection (FIG. 5,140). Also, the leaky air register (112, 113) to flex duct (110) connection may be in a tight very narrow corner space in the attic (FIG. 5,140) near a window which is typical. This is why it is very important that a flex duct (110) to register (112,113) connection be airtight.

A proper flex duct (110) to air register boot (113) connection is made with the following steps.

First the installer must strip the existing flex duct to register box boot (113) bare removing all sealer tape and zip ties or clamps, then dispose of the old duct. Next the installer will then take the end of the flex duct (110) (FIG. 3) peel back the protective mylar jacket (118) (FIG. 3) and glass wool insulation (116) exposing the plastic and wire tubing (117) 3-4". Next, the worker connects the plastic round tubing (117) over the sleeve of the register box boot (113) overlapping the sleeve 2-3" then secure the connection with a plastic zip tie fastener (126), then follow up by taping over the connection with duct tape.

Next the worker pulls the glass wool insulation and mylar membrane (116, &118) over the coiled plastic tube (117) & register boot connection (113) and tapes the outer membrane (118) and glass wool insulation (116) to the register boot (113) with duct tape then secures that connection with one or more zip tie fasteners (126). After the flex duct (110) & register boot connection (FIG. 2, 128) is secure, the worker brushes mastic duct sealer on to the connection to ensure a permanent and airtight connection. These steps are then repeated for all air registers (112) in the building.

In the construction phase of a building, HVAC trade workers are usually one of the first trades in to work right after the rough base framing of a building has been done. HVAC workers usually lay ductwork (110) ahead of plumbers, electricians and drywallers. This is because ducts (110) are big and bulky and other trades have slimmer water pipes, electrical wires, communication cable, gas pipe, which all can all be installed under, over and around bulky flex duct (110.). It typically does not work better vice versa.

Once a building is complete and all the trades are finished, the attic is no longer open. The drywall ceiling has been put up. Gas pipes, water pipes, communication cables, light ballasts, electrical wires, exhaust vents duct work and cross braces are everywhere. The attic is now a crowded and dark place.

After some time passes, the owners may want to get rid of all their old duct work (110) and install all new duct work (110) in the attic. Installing new duct work (110) isn't going to be as easy as it was during construction of the house. There are going to be some access challenges in the now crowded attic space. The duct Installer must connect new ducts to existing registers (FIG. 5,140). To begin the job, first, the technician must remove all the existing ductwork (110) which requires him to crawl in the attic in narrow spaces most of the time he will be stretched out straight on his belly (FIG. 4 & FIG. 5, 140) across the ceiling rafters reaching out with both hands to cut out and disconnect the old and existing flex duct end (110) to register box boot connection (113). This is a very dangerous position for a duct installer to be in as the attic is very hot in the summer and prolonged time in the attic can cause dehydration, heat exhaustion, cramps, stroke, heart attacks, which all can lead to death. The installer being in an awkward position in the attic is also at risk from falling through the drywall or getting electrocuted by a bare electrical wire he did not see but lay over. So, installers sometimes just leave the old existing duct connection in place and splice onto that old flex duct (110) a few feet back with new flex duct (110) where the installer is within reach to work comfortably. Doing this lowers the efficiency of the entire NC system because the old ducts that were left in place are most likely leaking air into the attic and not the intended conditioned space.

Currently there is no known method or product on the market that solves this problem. The current invention solves this problem by providing a design and method that makes it much easier and safer for a duct installer to disconnect an old flex duct connection from an existing hard to access air register (112) (110) and install a new flex duct connection onto the existing hard to access air register (112) located in a narrow attic space. This makes it much easier and safer for a duct installer to install a hard to access flex duct (110) branch while safely connecting the flex duct end (110) to an air register boot (113) without needing to physically make the duct connection or seal the duct connection while inside the attic space. The current invention also eliminates the need to crawl through an attic space up to air registers (FIG. 4, 140) for the purpose of disconnecting the flex duct (110) from the air register (112) boot, and also eliminates the need to crawl up to air registers through an attic space with a flex duct end connection (110) in hand for the purpose connecting the duct end connection (110) to the air register (112) boot (113) in the attic.

The product is called the Fish-A-Duct™ (101). The invention (101) is a round sheet metal duct sleeve flex connector that has a female treaded (105) pole hinge (104) connected to the body of it. The female threaded pole hinge (104,105,106) is connected to the invention (101) and allows a duct installer to insert a male threaded (123) lengthy telescopic pole (107) into the female threads (105) of the pole hinge (104) making it possible to "fish" the duct (101) sleeve with a length of flex duct (110) connected to one end (FIG. 1, 108) through a very narrow space in the attic very near where a hard-to-reach air register (112) is located. The invention (101) also has a flat rigid metal bar (102) that is riveted permanently across the inner circumference of the sheet metal body (101). The flat metal bar (102) is for the purpose of a gripping handle (102) for the installer to grab and manipulate the invention (101) so the installer can pull, push, and position the invention's crimped male end connection (FIG. 2,109) into the female boot (113) of the air register box. The invention (101) also has multiple ½" thin metal bracing straps (103) that are attached to the invention (101). The bracing straps (103) are up to 12" in length. One end of the bracing strap is permanently riveted to the inner wall of the sleeve and the other end of the bracing strap (103) is free until it is time to install the invention and brace it down to the inner walls of the metal air register (112). The bracing straps (103) are rotatable 360 degrees. The unanchored, free end of the bracing straps (103) remains in the upward position sheltered inside the assembly (101) until it is time to install the invention (101).

The invention (101) connection that will be fished by pole (FIG. 4,107) and dropped near the hardly reachable air register (112) in the narrow attic will have a length of flex duct (110) connected to one end of the assembly sleeve (FIG. 1, 108). This method eliminates the need to crawl up to the supply register (112) on hands and knees through the narrow attic space with a flex duct end connection (110) in hand in order to take the flex duct end connection near the air register boot 113 (FIG. 5, 140). The proper use of the product (101) goes as follows. The duct installer will take the lengthy pole (107) insert and screw the male treads (123) into the female threaded hinge (104) lift the invention (FIG. 4, 139) and guide the assembly (101) connection with flex duct (110) through the narrow attic space laying the flex duct (110) and the fish a duct connection (101) near the intended air register (FIG. 4, 112). Once the assembly connection (101) with flex duct (110) is less than 12" away from the intended air register (112) to be connected, the installer will then unscrew the telescopic pole (107) in reverse motion loosening the pole's male threads (123) from the female threads (105) of the pole hinge (104), totally disengaging the pole (107) from the assembly (101). This action will leave the entire assembly (101) and the length of flex duct (110) connected to one end (FIG. 1, 108) of the sleeve within 12" of the intended air register in the attic. Before the new invention connection (101) can be connected to the existing air register (112) the old flex duct connection (110) must be disconnected from the air register (112) box. Typically, to remove the existing flex duct connection from an air register boot (113) in a narrow, hard-to-reach space, a duct installer will have to crawl on his hands and knees with a knife and some cutting pliers through a narrow attic and get up face to face with the air supply register (FIG. 5, 140, 112) in order to cut through the flex duct (FIG. 3, 110), duct tape, hardened mastic and plastic straps. After the connection is removed, the entire length of the flexible duct (110) can be removed from the attic and disposed of. Disconnecting a flex duct (110) from a register box (112) in an attic is a very difficult task, especially when the attic is very narrow and a worker barely fits in the cavity workspace (FIG. 5, 140). However, using the invention method of removing a flex duct (110) connection from air register boot (113) the task is not so difficult. First, the installer will exit the attic and enter the living space (141) where the target air register (112) is located. He will then locate the target air register (112) in the ceiling. He will then put up a ladder, climb up and remove the air register grill of the target air register (112) exposing the sheet metal register box (112) inside the register box (112) the installer will look up and see the plastic and coiled wire internals of a flex duct (FIG. 3, 117).

Next the installer will take a sharp knife and cut the flex duct (110) out from the inside out. The installer will then take his wire cutters and cut the wire that is fused on to the thin plastic sheeting (FIG. 3, 117) disconnecting the flex duct (110) entirely from the sheet metal boot (113) of the register box (112). The old length of duct (110) that was connected can now be removed from the attic and disposed of, and the new length of flex duct (110) can be "fished in" and placed near the air register by pole (107) with the assembly (101) connected to it. Now standing on the ladder in the living space (141), the installer looks up into the air register (112) in the ceiling and sees the round female boot (113) sleeve of the air register box with no duct connection. The duct installer on the ladder in the living space (141) will now stick his hand through the supply register boot opening (112, 113) into the attic and grab the nearby assembly (101) by the flat gripper bar (102). The open end of the assembly sleeve (FIG. 1, 109) does not have the flex duct end (110) attached to it is the round crimped male duct connection sleeve (FIG. 1,109). With the assembly (101) now in the installer's hand holding it by the center of the gripper bar (102) the installer will now align the male connection sleeve (109) of the invention (101) to the female boot (113) of the register box (112). Gripping the crossbar gripper handle (102), the installer will now apply pulling pressure downward pulling firmly on the crossbar (102) ensuring the crimped male connection (109) of the assembly (101) is snug and well positioned inside the female boot (113) of the register box (112). once a snug connection is achieved. The installer will reach inside the invention connection and rotate the ends of the ½" metal security straps (FIG. 2, 103) downwards towards the walls of the register box (112). The installer will pull on a strap (103) with pliers and create tension reenforcing a snug male to female duct connection. The installer will then anchor the tensioned strap to the wall of the register with a sheet metal screw (FIG. 2, 111). The installer will repeat this process for as many bracing straps (103) are provided on the invention assembly (101). The anchoring of the security straps (102) creates a permanent and seismic stability that will last for many years. The installer will remain on the ladder closely observing the seam area where the male and female connections are joined. The installer will see that there are small air gaps at the seam between the two joined connections of the connection (101) and the register boot (113). The installer will then seal the gaps with silicon or an approved sealer. Once the sealer is dry, the connection between the assembly (101) and the air register (112) is now airtight and complete. This process can be done even easier and faster when two people are involved. For example, installer #1 (FIG. 9, 168) can be standing on the ladder (167) in the living space (141) with his arm reaching through the open air register (112) into the attic with his hand in the catching position ready to receive the assembly (101) from installer #2 (169) who is in the attic space guiding the invention (101) and flex duct (110) by pole (107) through the narrow attic and directly into the hand of installer #1 (168) who will grab it by the gripper bar (102) so he can make the male invention connection (109) to female register boot (113) connection. Duct installer #1 can now re-enter the attic to help installer #2 (169) route the flex duct branch and connect to the air supply plenum (125) as done typically then finish the rest of the duct installation as done typically While installing the assembly (101) the installer may encounter a problem with the pole hinge (104) causing the invention not to properly connect to the register boot (113) because of its mounted position on the invention. For example, since the pole hinge protrudes about 4" from the assembly (104) there may be a cross beam or a pipe near the register (112) that will interfere with clearance of the invention (101) to the intended register (112). The installer can overcome this problem by (FIG. 8) taking a screwdriver and loosening the bracing screw (154) of the top pole hinge fastener (155). This action takes pressure off the bottom male peg (152) of the adjustable pole hinge (104). The installer can remove the pole hinge (104) separating the bottom male peg (152) from the mounted top hinge fastener (155). The Installer may now locate an ideal place on the assembly (FIG. 6, 161) to re-install the pole hinge. Once a spot has being figured (FIG. 6, 161) the installer will drill a ½" round hole into the assembly, at (122). The installer will then tear open the bag and remove the parts to the pole hinge relocation kit (FIG. 8). The installer will then take the new top hinge fastener (155) from the kit (FIG. 8) and push the ½" male bolt (157) through the newly drilled ½" hole in the Assembly (FIG. 6, 122). He will then take the inner washer (160) from the kit (FIG. 8) and loop the fastener bolt threads (157) inside the assembly (122). The installer will then take the ½" nut (158) from the kit (FIG. 8) and thread the bolt (157) from the inside of the assembly.

The installer will tighten the nut (158) forcing clamping pressure between the inner washer (160) and the top hinge fastener (155) affixing the top hinge fastener (155) firmly to the assembly at (122). The installer will then drill 2-4 metal screws into the pilot holes (156) on the top hinge fastener (155) reenforcing the connection to the assembly (122). The installer can now take the pole hinge (104) and insert the bottom male peg (152) into the female sleeve (153) of the top hinge fastener (155). The installer will now tighten the bracing screw (154) creating a tight connection between the hinge top fastener (155), the adjustable pole hinge (104) and the assembly (122). The installer can now install the assembly (122) onto the air register (112) without any clearance issues. So far what has been explained is the description of the assembly (101) invention and its function. The design in FIG. 1 is the straight sleeve version of the assembly. There are two more shapes that have the same function and wear the same hardware. They are also installed in the same method; the only real difference is the shape of the body. The first of the two additional shapes are the adjustable 90-degree elbow shape assembly (FIG. 6-122). The 90-degree elbow (122) is a cylinder shape sheet metal duct that can be adjusted to many angles between 0-90 degrees. The elbow (122) gives the installer the advantage of installing it onto a register (112) and not having to worry about air flow issues due to a kinked duct as most flexible duct runs (110) are ran horizontally then bent down vertically to a 90-degree angle kinking the unrigid flexible duct. The installer will then have to climb through the narrow attic up to the kinked duct and place hanger strap to position the duct in a manner that it is not kinked and air can flow at maximum efficiency. Using the rigid elbow version (FIG. 8-122) quickly solves any restricted air flow issues as well as makes it easier to replace a hardly accessible register (112) duct connection in the attic space. The elbow duct (122) has a flat metal gripper bar (102) that is riveted onto the inner walls of the elbow duct (FIG. 8,122) toward the bottom male duct crimped connection (109). The elbow duct (122) has a number of ½" bracing straps (103) anchored to the inner walls of the elbow (122). The elbow duct (122) has a female threaded (105) adjustable pole hinge (104) fixed to the elbow duct (122) assembly near the male flex Duct connection end (108).

The third shape is the box assembly (FIG. 7, 119). The box assembly (119) is a slim and low-profile rectangle shape variation of the assembly family. The box duct (119) dimensions vary in size 2"-10" height (FIG. 7-131), 5"-20" depth (FIGS. 7-130), and 6"-200" width (FIG. 7-132). The box duct (119) has a square to round transition connection (120)

on the flex duct connection side of the box duct assembly (119). The box duct (119) has a pole hinge (104) fixed on the square to round transition (120) part of the box duct (119). The opposite end of the transition (120) side of the box duct (119) has a round diameter sheet metal air supply duct collar (150) cut in and attached to it. The duct collar (150) has a flat metal gripping bar (102) riveted to the inner walls of the collar (150). The collar (150) also has a number of ½" bracing straps (103) riveted to the inner walls of the collar (150) the purpose of the slim and low-profile shape makes it Ideal when there is very little space to work with when replacing a duct connection. This is when it is pretty much impossible for a human being to crawl into a very narrow attic space (FIG. 5-140) to access a duct (110) to register connection (FIG. 5-112). Until now, the only option to access this type of duct (110) to register (112) connection in order to disconnect the duct connection for replacement would be to remove sections of drywall in the ceiling in order to access the duct to register connection (FIG. 5, 112). Using the described method of disconnecting a flex duct (110) to register boot (113), installer #1 will put up a ladder locate the target air register in the ceiling, remove the register grill exposing the plastic and wire coil internals (FIG. 3—117) and cut the duct out from the inside out. He will then take his wire cutters and cut the metal wire disconnecting the old duct from the air register box (112). Installer #2, who is in the attic, will pull on the opposite end of the old duct work and remove the ductwork from the attic. Installer #1 will remain on the ladder and put his arm through the register duct boot (113) into the attic space with his hand in catching position. Installer #2 who is in the attic space will take the lengthy pole (107) and screw the male threaded end (123) to the female treads (105) of the adjustable pole hinge (104) that is attached to duct (119). The assembly (119) will have the required diameter and length of duct (110) attached to the metal flex connection collar (121) on one end of the box v assembly. Installer #2 will then lift and guide the low-profile duct (119) through the narrow attic and directly towards the hand of installer #1. Installer #1 will grab the box assembly (FIG. 7—119) by the flat gripper bar (102). Installer #2 will now disconnect the pole (107) from the female threads (105) of the pole hinge (104) by turning it in reverse motion. Installer #1 will then align the crimped male collar connection (FIG. 7, 109) with the female register boot sleeve (FIG. 7, 113). The installer will then pull down applying downward pressure ensuring a snug male assembly collar (109) to female air register boot (113) connection. Installer #1 will then rotate the bracing straps (103) downward towards the inner walls of the air register pull on the straps with pliers to create tension and then screw the tensioned bracing straps to the inner walls of the air register (FIG. 2-111). The installer will then inspect the seam where the new duct connection was joined and seal all air gaps with caulking or approved sealer. The low-profile box assembly is now installed.

Advantages over the prior art.

The invention allows for safer replacements of duct connectors.

The invention saves time and money in that a new duct can be 'fished' to an existing register box without endangering the workers or the roof of the building.

Since many hard-to-reach ducts never actually get replaced even when a homeowner pays for a full duct replacement, as the hard-to-reach ducts are seen as simply too dangerous to replace. With this invention, more leaky ducts will get replaced with new airtight ducts therefore saving energy and greatly reducing the carbon footprint on the environment.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A duct sleeve flex connector for connecting a new duct to an existing register box, consisting of: a body with a duct end and a register box end, with an outer surface and an inner surface, a flat, rigid metal bar, two or more metal bracing strips, and a female-threaded pole hinge, where the flat, rigid metal bar has two ends, where a first end is attached to a first location of the inner surface of the body, and a second end is attached to a second location of the inner surface of the body, where the first location is 180 degrees opposite the second location, where each end of the flat, rigid metal bar is attached to a metal bracing strip, where the metal bracing strip can rotate 360 degrees, where the female-threaded pole hinge mates with a male-threaded end of a telescoping pole.

2. The duct sleeve flex connector of claim 1, where the duct sleeve flex connector is a cylinder with a 90-degree bend in it.

3. The duct sleeve flex connector of claim 2, where the duct sleeve flex connector is a rectangular box with a round outlet exit.

4. The duct sleeve flex connector of claim 1, where the duct sleeve flex connector is a cylinder.

* * * * *